US005167493A

United States Patent [19]

Kobari

[11] Patent Number: 5,167,493

[45] Date of Patent: Dec. 1, 1992

[54] POSITIVE-DISPLACEMENT TYPE PUMP SYSTEM

[75] Inventor: Yuji Kobari, Yokosuka, Japan

[73] Assignee: Nissan Motor Co., Ltd., Japan

[21] Appl. No.: 791,836

[22] Filed: Nov. 14, 1991

[30] Foreign Application Priority Data

Nov. 22, 1990 [JP] Japan ..... 2-315881
Mar. 26, 1991 [JP] Japan ..... 3-84579

[51] Int. Cl.[5] ..... F04B 49/00
[52] U.S. Cl. ..... 417/273; 417/427
[58] Field of Search ..... 417/427, 426, 286, 270, 417/273, 295

[56] References Cited

U.S. PATENT DOCUMENTS 1,636,258 7/1927 Svartz ..... 417/427 X
3,000,319 9/1961 Tuck ..... 417/270
4,430,047 2/1984 Ilg ..... 417/426 X
4,690,620 9/1987 Eickmann ..... 417/273
5,032,065 7/1991 Yamamuro et al. ..... 417/428
5,094,597 3/1992 Takai et al. ..... 417/427 X

FOREIGN PATENT DOCUMENTS 2924768 1/1981 Fed. Rep. of Germany ..... 417/273
1-262374 10/1989 Japan .
427161 11/1974 U.S.S.R. ..... 417/273

*Primary Examiner*—Leonard E. Smith
*Attorney, Agent, or Firm*—Lowe, Price, LeBlanc & Becker

[57] ABSTRACT

A positive-displacement type pump system, such as a fixed-cylinder type radial piston pump system, includes a common pump housing formed with a plurality of cylinders, and a plurality of pistons slidably received in the respective cylinders and cooperating therewith to form a plurality of pump units. A first throttle valve is disposed in a first suction passage of a first group of the pump units for operating a first actuator, for adjusting the flow rate of a working fluid to be supplied to the these pump units. A second throttle valve is disposed in a second suction passage of a second group of the pump units for operating a second actuator, for adjusting the flow rate of the working fluid to be supplied to the pump units of the second group independently from those of the first group. The pump units of the first and second groups can thus be individually adjusted in terms of the respective delivery volumes.

14 Claims, 13 Drawing Sheets

POSITIVE-DISPLACEMENT TYPE PUMP SYSTEM

BACKGROUND OF THE INVENTION

1. Field of the Invention

The present invention relates to a positive-displacement type pump system, such as a fixed-cylinder type radial piston pump system, whose delivery volume can be adjusted depending upon requirement for an actuator to be operated with a pressurized working fluid discharged from the pump system.

2. Description of the Related Art

Such a pump system is disclosed, for example, in Japanese Patent Application Laid-open Publication No. 1-262,374, and typically includes a common pump housing formed with a plurality of cylinders, a plurality of pistons slidably received in the respective cylinders and cooperating therewith to form a plurality of pump units, an eccentric drive shaft extending into the housing for driving the pistons into reciprocating motion within the respective cylinders, and a common suction passage between a working fluid source and the pump units.

In order to minimize the energy consumption for driving the pump system, the pump system should discharge the minimum quantity or volume of working fluid required for one or more actuators to be operated by the working fluid which has been pressurized by the system. For enabling an adjustment of the delivery volume of the pump system as required from time to time depending upon requirement for the actuator, a typical approach would be to adjust the eccentricity of the drive shaft. However, such an approach necessarily makes the entire system complex in structure and less reliable in operation. Thus, in view of these drawbacks, the publication cited above further discloses the provision of a throttle valve disposed in the suction passage between the working fluid source and the pump units, for adjusting the flow rate of the working fluid from the working fluid source to be supplied to the pump units.

When the pump units of a single pump system are classified into a plurality of pump unit groups for individually supplying pressurized working fluid to different actuators, there may be a situation where it is only for one group of the pump units whose delivery volume is to be adjusted. On such occasion, however, the adjustment by means of the throttle valve disposed in the common suction passage is inevitably influential on the delivery volume of another group of the pump units for which delivery volume should not be adjusted. It has therefore been considered impossible to apply the unique teachings of the aforementioned publication for individually adjusting the delivery volume of the pump units of the different groups.

SUMMARY OF THE INVENTION

Accordingly, it is an object of the present invention to provide an improved positive-displacement type pump system which makes it readily possible to individually adjust the delivery volume of the different groups of the pump units of the system.

The present invention thus provides a positive-displacement type pump system which includes a common pump housing formed with a plurality of cylinders, a plurality of pistons slidably received in the respective cylinders and cooperating therewith to form a plurality of pump units, a drive shaft extending into the housing for driving the pistons into reciprocating motion within the respective cylinders, and a novel control device which serves to individually adjust the delivery volumes of the pump units.

More particularly, according to the present invention, the control device for individually adjusting the delivery volumes of the pump units includes at least (i) a first throttle valve disposed in a first suction passage between a working fluid source and a first group of the pump units for operating a first actuator, for adjusting a flow rate of a working fluid from the working fluid source to be supplied to the pump units of the first group, and (ii) a second throttle valve disposed in a second suction passage between the working fluid source and a second group of the pump units for operating a second actuator, for adjusting a flow rate of the working fluid from the working fluid source to be supplied to the pump units of the second group independently of those of the first group valve, thereby allowing the pump units of the first and second groups to be individually adjusted in terms of their respective delivery volumes.

BRIEF DESCRIPTION OF THE DRAWINGS

The present invention will now be explained in further detail hereinafter, by referring to some specific embodiments illustrated in the accompanying drawings, wherein.

DETAILED DESCRIPTION OF THE PREFERRED EMBODIMENTS

Figure 1:
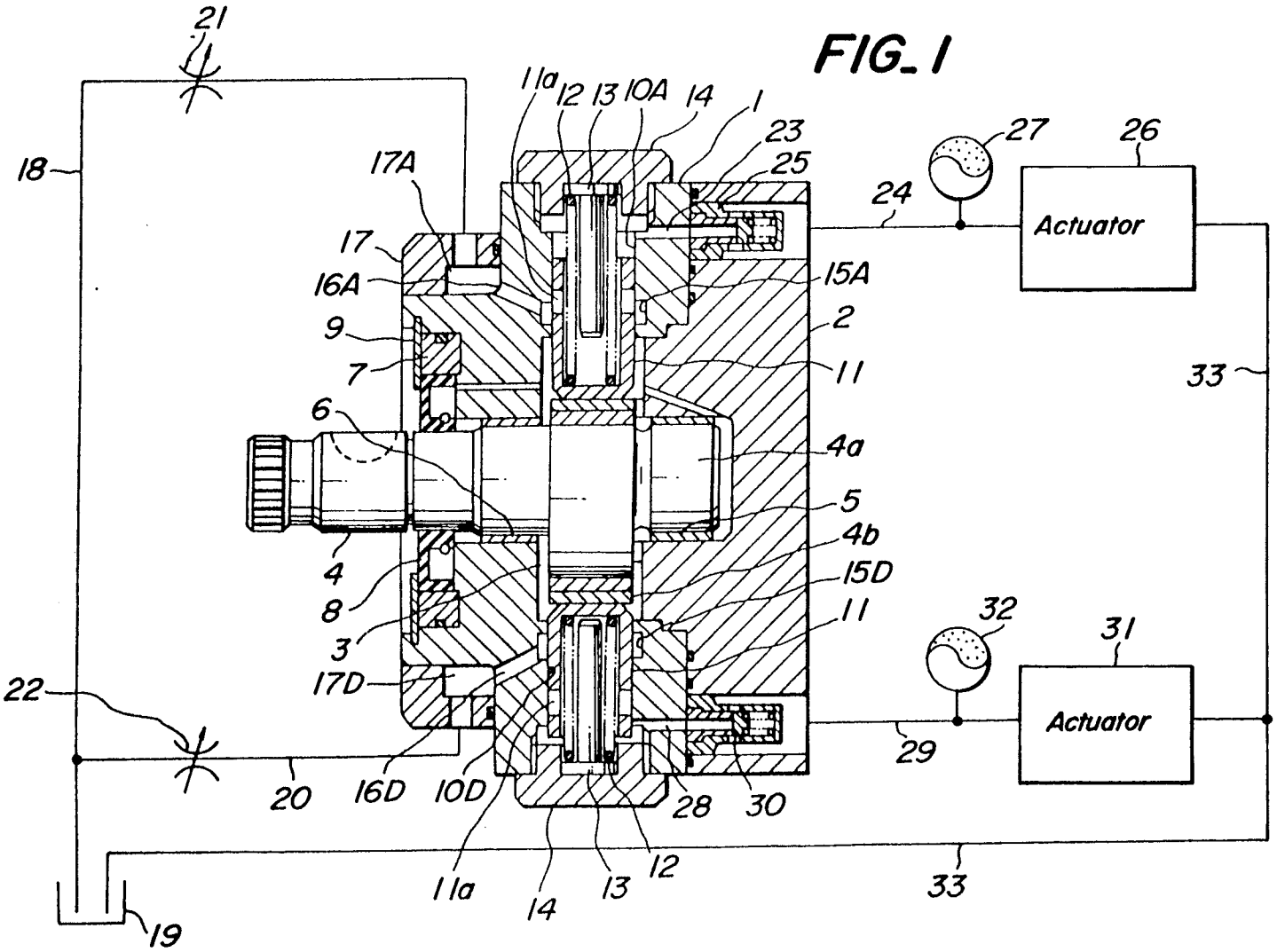
FIG. 1 is a longitudinal-sectional view showing a fixed-cylinder type radial piston pump system according to one embodiment of the present invention.
Figure 2:
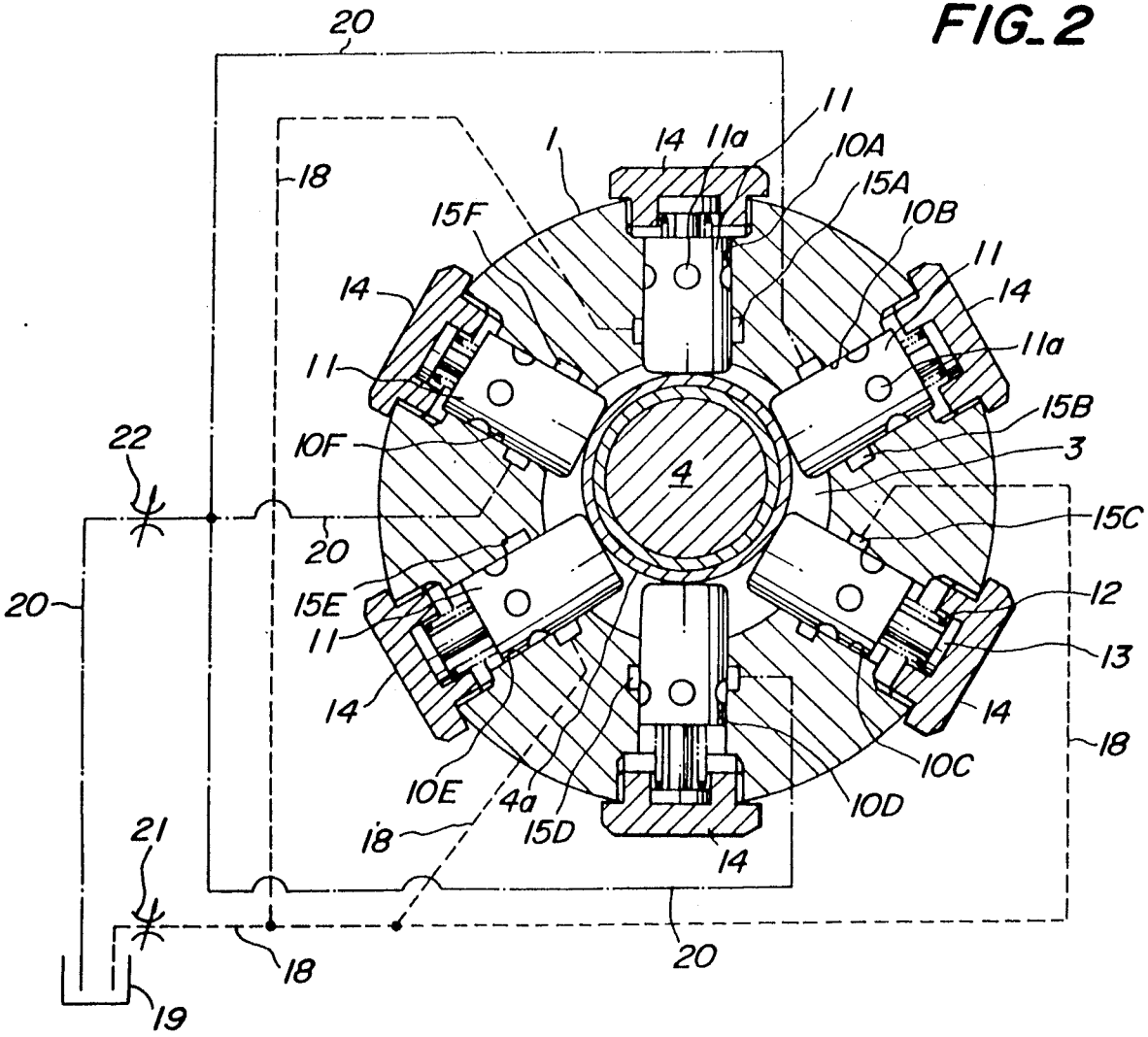
FIG. 2 is a cross-sectional view thereof.

Referring now to FIGS. 1 and 2, there is shown a fixed-cylinder type radial piston pump system according to one embodiment of the present invention, which includes a pump housing denoted as a whole by reference numeral 1. A cover member 2 is secured to the pump housing on its discharge side to define a center chamber 3 within the housing 1. A drive shaft 4 extends through the center chamber 3 of the housing 1 with its free end portion 4*a* journalled by the cover member 2, and is provided with an eccentric cam element 4*b*. The drive shaft 4 is adapted to be driven by an appropriate prime mover, such as an internal combustion engine of an automotive vehicle, not shown. The drive shaft 4 is associated with bearing bushes 5, 6, and a collar 7 serves to retain an oil seal element 8 for the drive shaft 4 together with a retainer ring element 9.

As particularly shown in FIG. 2, the housing 1 is formed with a plurality of cylinders 10A–10F, for example six in number, which are arranged equiangularly about the eccentric cam element 4*b* of the drive shaft 4 in the center chamber 3 to extend radially with reference to the longitudinal axis of the drive shaft 4. Hollow cylindrical pistons 11 ar slidably accommodated within the respective cylinders 10A–10F and cooperate with each other to form a plurality of pump units. In the illustrated embodiment, the pump units including the cylinders 10A, 10C, 10C and the pistons 11 associated therewith are classified as a first group pump units. Similarly, the pump units including the cylinders 10B, 10D, 10F and the pistons 11 associated therewith are classified as a second group pump units. Preferably, the pump units of each group are arranged at an equiangular relationship with respect to each other, e.g. at an interval of 120° as in the illustrated embodiment.

A compression coil spring 12 is arranged within the interior space of each piston 11, and is retained at its radially outer end with a retainer element 13 and compressed by a cap element 14 threadedly secured into the housing 1. Thus, the radially inner end of the spring 12 urges the piston 11 against the eccentric cam element 4*b* of the drive shaft 4 so that the piston 11 undergoes a reciprocating motion in the radial direction of the drive shaft 4 as the drive shaft 4 is rotated.

Each piston 11 is formed with a suction port 11*a* in the form of an opening extending through the piston wall, which is adapted to bring the interior space of the piston 11 into communication with the suction side of the relevant pump unit. Thus, the cylinders 10A–10F are respectively formed with annular grooves in their inner circumferential walls as oil chambers 15A–15F which are connected with oil passages 16A–16F. These passages 16A–16F terminate at external openings which are in communication with oil chambers 17A–17F formed in a front cover member 17 which is secured to the housing 1.

The oil chambers 15A, 15C, 15E for the first group pump units are connected, through the oil passages 16A, 16C, 16E and the oil chambers 17A, 17C, 17E, respectively, to an oil passage 18 which extends from a reservoir 19. Similarly, the oil chambers 15B, 15D, 15F for the second group pump units are connected, through the oil passages 16B, 16D, 16F and the oil chambers 17B, 17D, 17F, respectively, to an oil passage 20 which also extends from the reservoir 19. These oil passages 18, 20 are provided with variable throttle valves 21, 22, respectively, for individually adjusting the flow rate of the working oil to be supplied to the first and second group pump units from the reservoir 19.

The first group pump units are connected on their discharge sides to a passage 23 which is connected to another passage 24 via a check valve 25. The passage 24 terminates at an inlet port of an actuator 26, and is shunt-connected to an accumulator 27. Similarly, the second group pump units are connected on their discharge sides to a passage 28 which is connected to another passage 29 via a check valve 30. The passage 29 terminates at an inlet port of an actuator 31, and is shunt-connected to an accumulator 32. The exhaust ports of these actuators 26, 31 are connected to an exhaust passage 33 which, in turn, is connected to the reservoir 19.

The operation of the radial piston pump system explained above with reference to FIGS. 1 and 2 will be explained below. As the drive shaft 4 is rotated, for example, by an internal combustion engine of an automobile vehicle, the eccentric cam element 4*b* of the shaft 4 drives the piston 11 within the cylinder 10A–10F of each pump unit into a reciprocating motion in the radial direction of the drive shaft 4. On this occasion, as for the first group pump units, the working oil from the reservoir 19 is sucked through the passage 18, the throttle valve 21, the chambers 17A, 17C, 17E, the passages 16A, 16C, 16E, the chambers 15A, 15C, 15E and the ports 11*a*, into the interior spaces of the pistons 11 during a stroke in which they are moved radially inwardly. The flow rate of the working oil to be supplied to the first group pump units is controlled by the throttle valve 21. Similarly, as for the second group pump units, the working oil from the reservoir 19 is sucked through the passage 18, the throttle valve 22, the chambers 17B, 17D, 17F, the passages 16B, 16D, 16F, the chambers 15B, 15D, 15F and the ports 11*a*, into the interior spaces of the pistons 11 during a stroke in which they are driven radially inwardly. The flow rate of the working oil to be supplied to the second group pump units is controlled by the throttle valve 22, independently of the flow rate of the working oil for the first group pump units.

Furthermore, the working oil sucked into the interior space of each piston 11 is pressurized by the pump unit during the stroke in which the piston 11 is driven radially outwardly. As for the first group pump units, the pressurized working oil from each pump unit is discharged through the passage 23, the check valve 25 and the passage 24, and delivered to the actuator 26. The working oil delivered to the actuator 26 is at a line pressure $P_L$ which is maintained substantially constant by means of the accumulator 27 connected to the passage 24. Thus, the actuator 26 is operated by the pressurized working oil with a desired line pressure $P_L$ and an optimum delivery volume. As for the second group pump units, the pressurized working oil from each pump unit is discharged through the passage 28, the check valve 30 and the passage 29, and delivered to the actuator 31. The working oil delivered to the actuator 31 is at a line pressure $P_L'$ which is maintained substantially constant by means of the accumulator 32 connected to the passage 29. Thus, the actuator 31 is operated by the pressurized working oil with a desired line pressure $P_L'$ and an optimum delivery volume. The working oil exhausted from the actuators 26, 31 is drained through the passage 33 and returned to the reservoir 19.

Figure 3A:
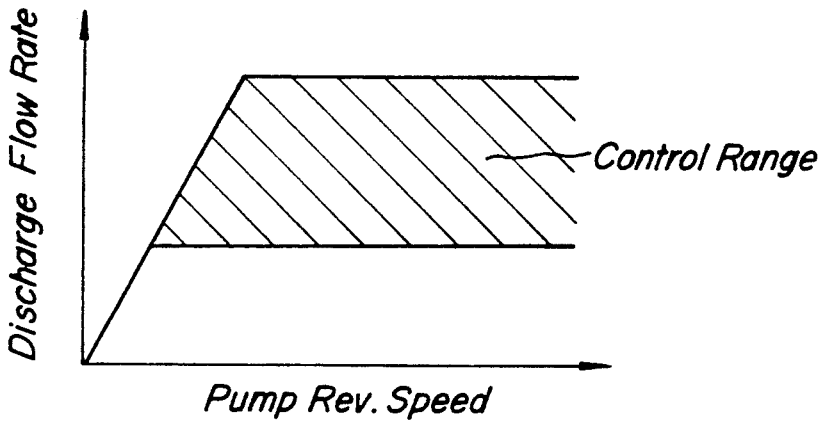
FIGS. 3A and 3B are diagrams graphically showing the discharge flow rate characteristics of the pump system of FIGS. 1 and 2.
Figure 3B:
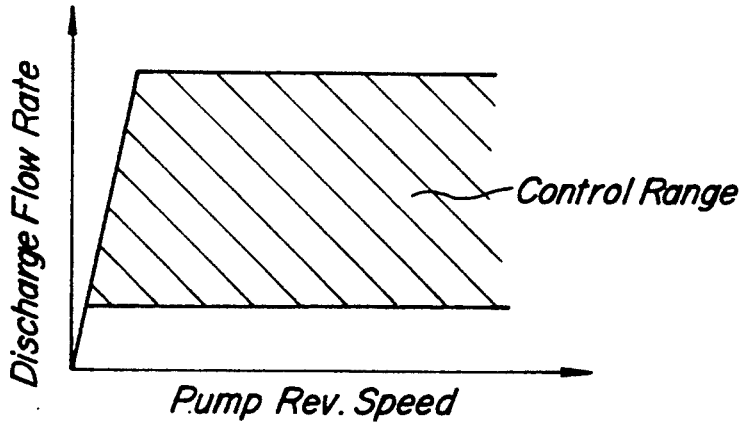

FIGS. 3A and 3B are diagrams each graphically showing the discharge flow rate or delivery volume characteristic of the relevant pump groups in relation to the rotational speed of the drive shaft 4 in the pump system of FIGS. 1 and 2. It may be assumed here that FIG. 3A shows the characteristic of the first group pump units for driving the actuator 26, and FIG. 3B shows that of the second group pump units for driving the actuator 31. Furthermore, in the diagrams of FIGS. 3A and 3B, the hatched regions each denotes the range in which the delivery volume of the working oil to be supplied to the respective actuators 26, 31 can be controlled by adjusting the opening degree of the variable throttle valves 21, 22.

According to the present invention, due to the provision of the variable throttle valves 21, 22 in the suction passages 18, 20 for the first and second group pump units, the working oil sucked from the common reservoir 19 can be separately supplied to the actuators 26, 31 with respectively optimum delivery volumes which may be different from each other. Thus, despite use of a single pump system, it is possible to individually control a plurality of actuators 26, 31 in optimum manner.

Referring now to FIGS. 4–10, different embodiments or modifications of the pump system according to the present invention will be briefly explained below wherein the same reference numerals as used in FIGS. 1 and 2 denotes the same or equivalent element thereby to eliminate superfluous description.

Figure 4:
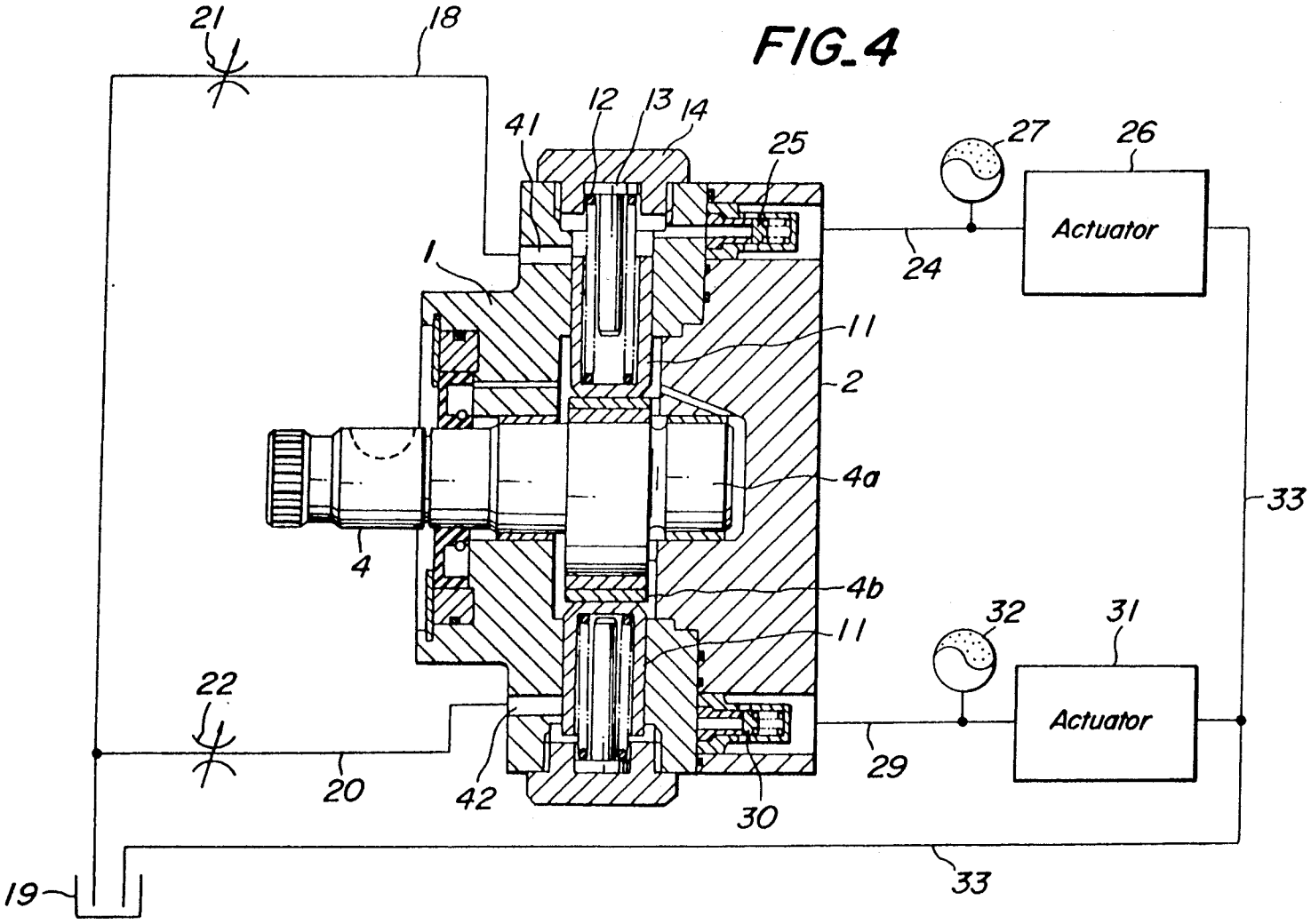
FIGS. 4 and 5 are longitudinal-sectional views showing different embodiments of the pump system according to the present invention.

The embodiment shown in FIG. 4 is substantially same as the previous one and differs therefrom in that, instead of the oil chambers 15A–15F on the suction side of the pump units and the suction port **11*a* in the form of an opening extending through the piston wall, the pump housing 10 is provided therein with suction ports in the form of oil passages 41, 42 which are disposed in the radially outer region of the cylinders 10A–10F and on radially inner side of discharge passages 23, 28. Thus, the suction ports of the pump units formed of the oil passages 41, 42 are either opened or closed by radially outer end region of the piston 11 as the drive shaft 4** is rotated.

Figure 5:
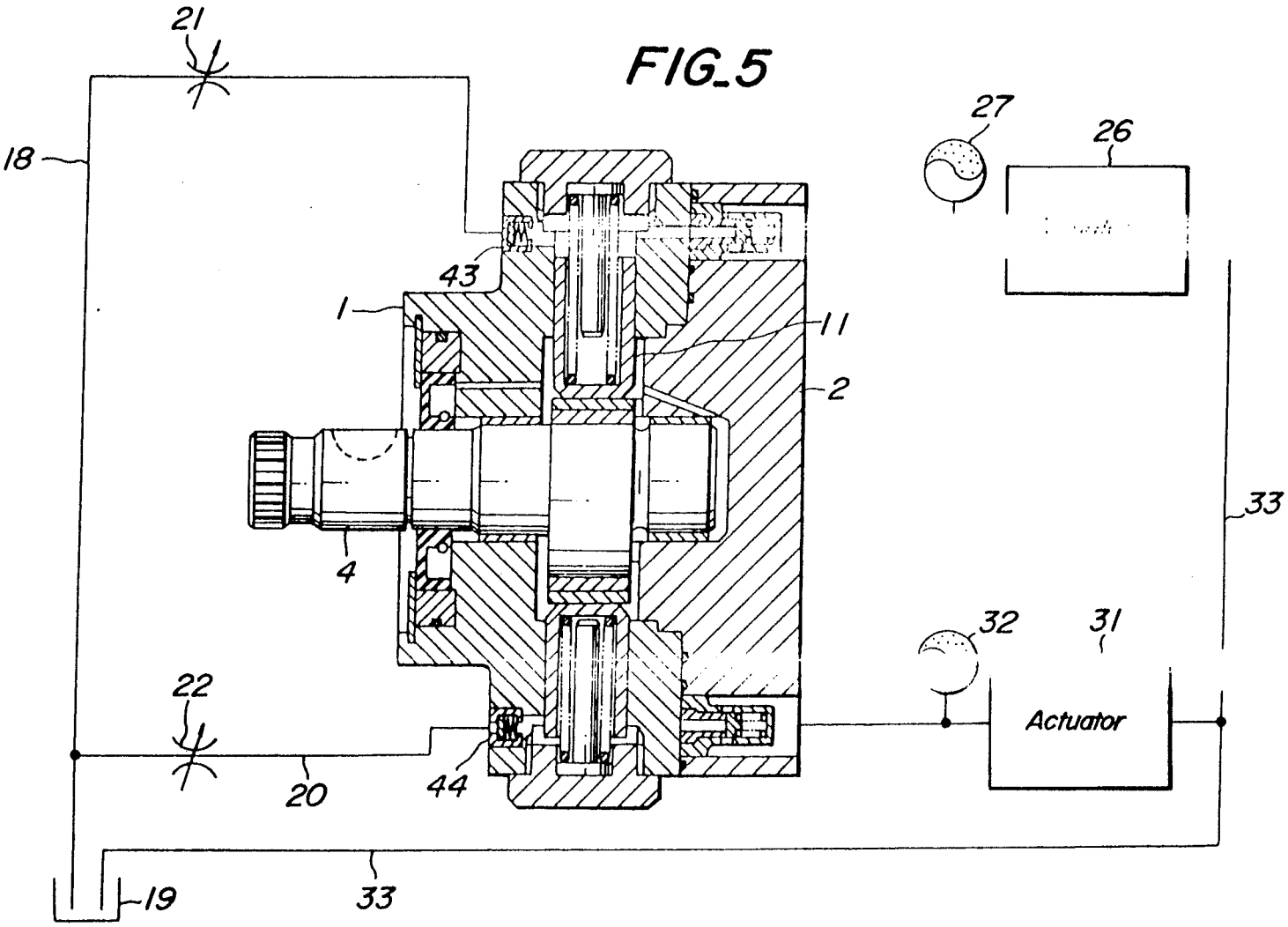

The embodiment shown in FIG. 5 is essentially same as that shown in FIG. 4 except that check valves 43, 44 are provided on the upstream sides of the oil passages 41, 42 forming the suction ports of the pump units. Provision of the check valves 43, 44 serves to eliminate formation of the grooves in the inner circumferential surface of the cylinders 10A–10F to reduce the number of machining steps and manufacturing cost, and also serves to prevent flow of the working flow back into the passages 18, 20 upon increase of the pressure in the interior space of the piston 11 or during the discharge stroke thereof.

Figure 6:
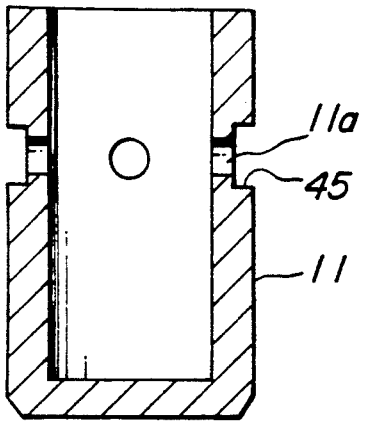
FIG. 6 is a sectional view showing a modified example of the piston for a pump unit.

FIG. 6 shows a modification of the piston 11 in the embodiment of FIGS. 1 and 2, wherein the piston 11 is formed in its outer surface with a circumferential groove 45, and the suction port **11*a* in the form of an opening extending through the piston wall is disposed in the bottom region of the groove 45 to bring the groove 45 into communication with the interior space of the piston 11. The groove 45 in the outer surface of the piston 11 serves as an oil chamber which can be readily formed as compared with the grooves 15A–15F in the inner circumferential surface of the cylinders 10A–10F. Thus, formation of the groove 45 in the piston 11** serves to improve the manufacturing productivity and to reduce the cost.

Figure 7:
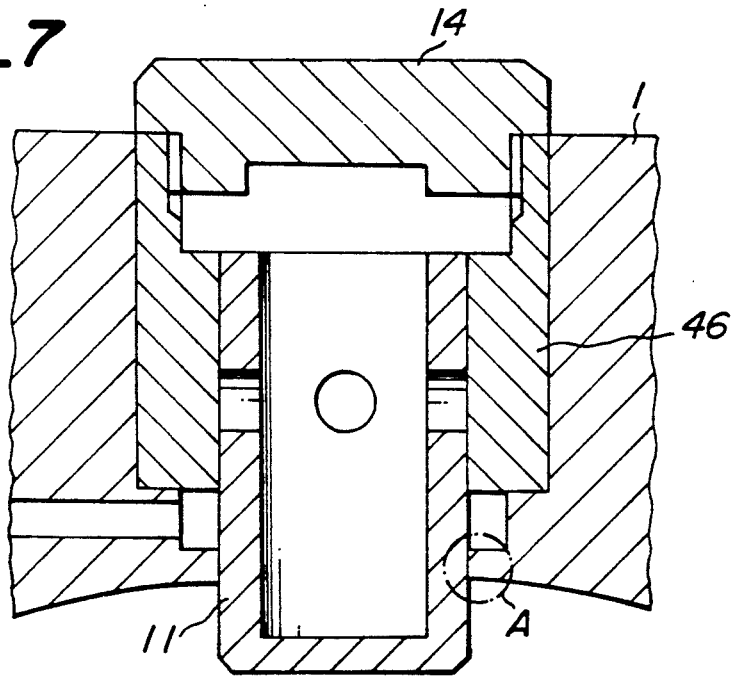
FIG. 7 is a fragmentary sectional view showing another modified example of the pump unit.
Figure 8:
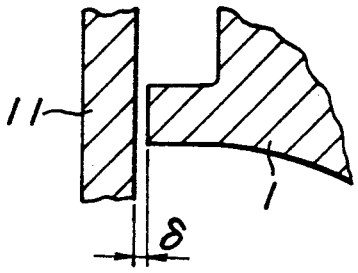
FIG. 8 is a detailed view showing the circled region A of FIG. 7 in enlarged scale.

FIGS. 7 and 8 show another modification of the pump unit wherein annular lining elements 46 are press-fitted into the cylinders 10A–10F of the pump housing 1 to eliminate formation of the grooves 15A–15F in the inner circumferential surface of the cylinders. As particularly shown in FIG. 8, a small clearance $\delta$ may be formed between the piston 11 and the pump housing 1 so as to reduce the friction therebetween for improving the operational efficiency of the pump units.

Figure 9:
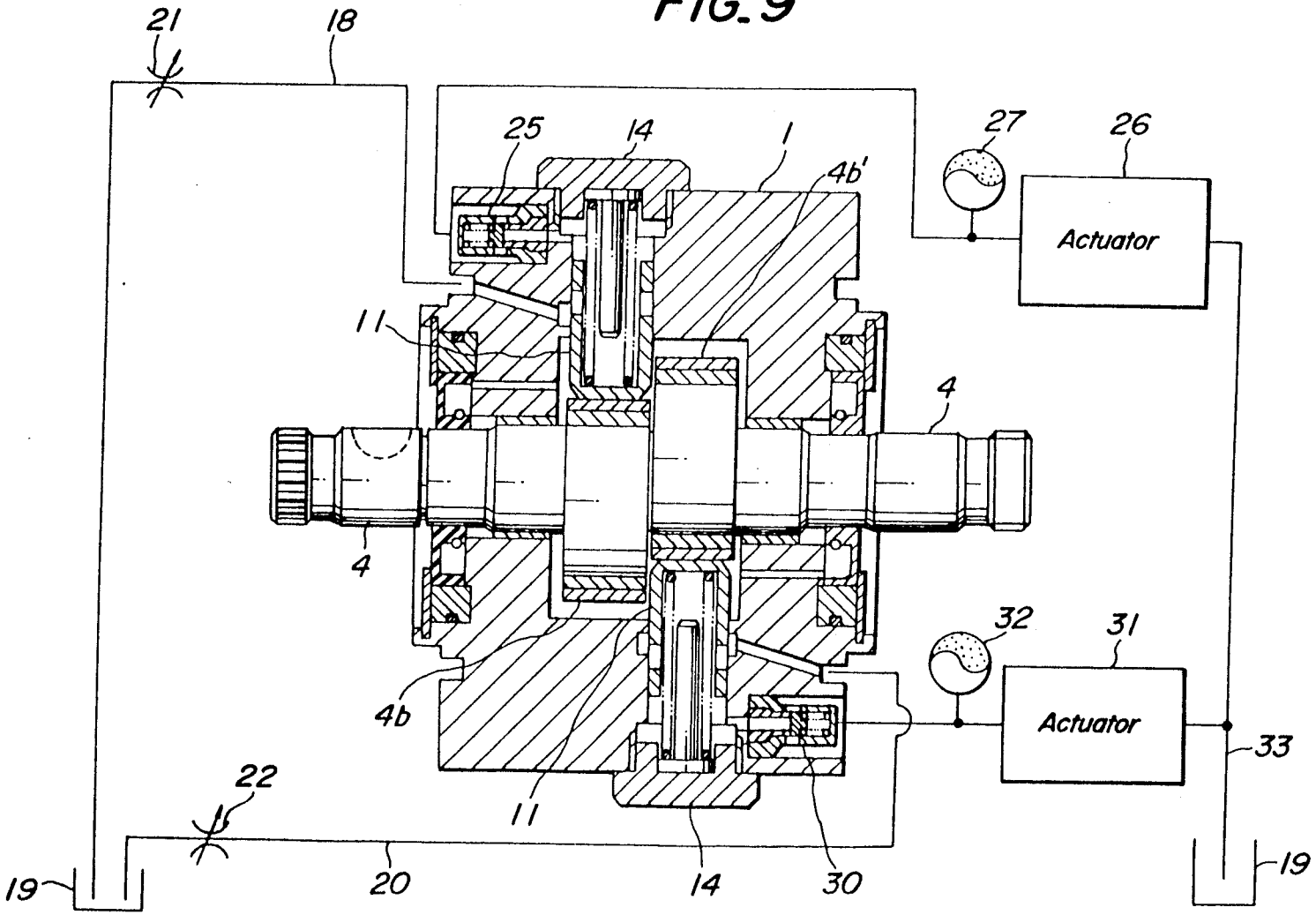
FIG. 9 is a longitudinal-sectional view showing a fixed-cylinder type radial piston pump system according to another embodiment of the present invention.
Figure 10:
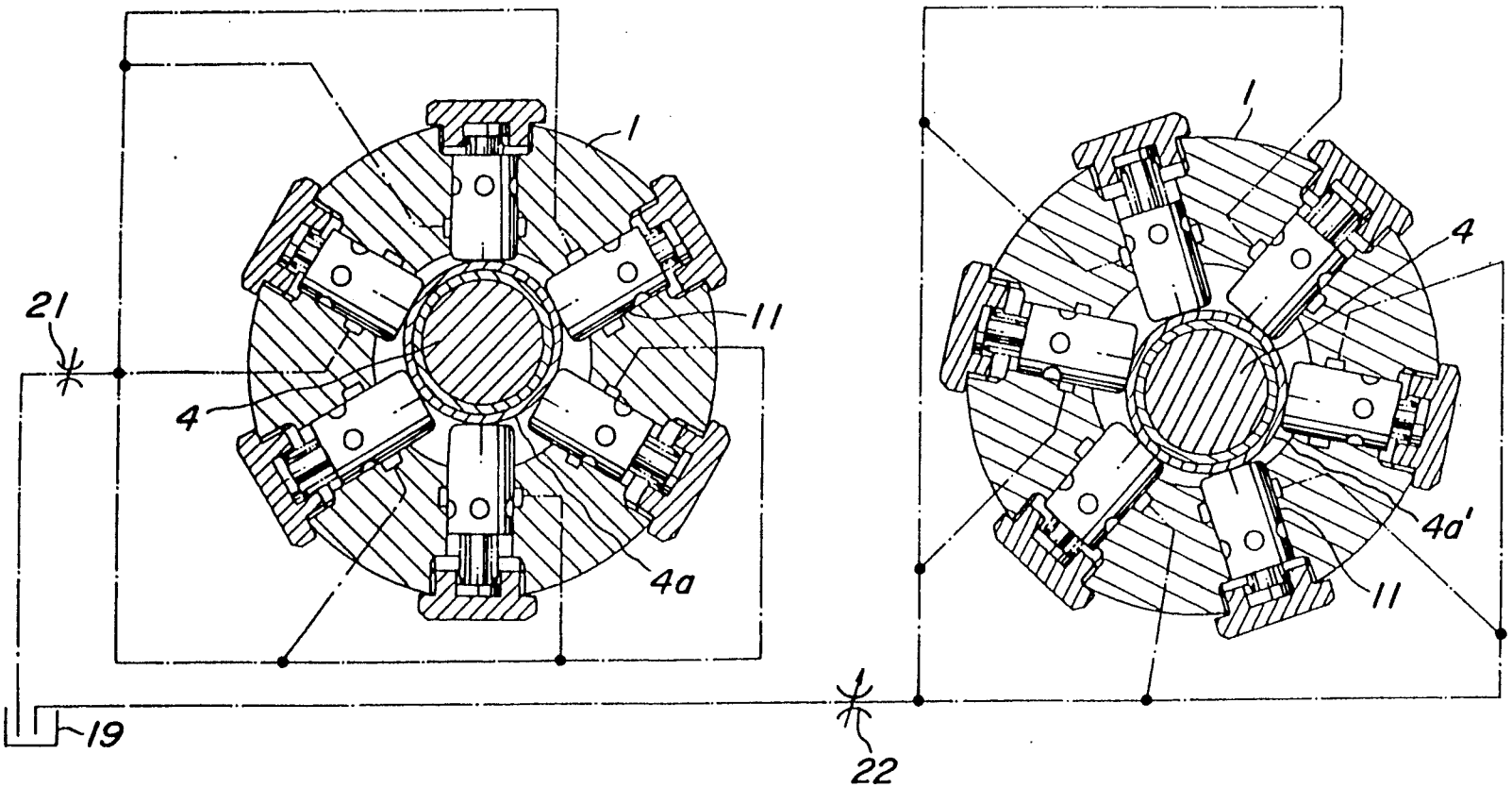
FIG. 10 is a schematic diagram showing the connection of two groups of the pump units in the pump system of FIG. 9.

FIGS. 9 and 10 show another embodiment of the pump system in which the drive shaft 4 is provided with two axially juxtaposed eccentric cam elements **4*b*, 4*b*' each being surrounded by six pump units. The six pump units around the first cam element 4*b*, which are shown on the left side of FIG. 10, are associated with the first variable throttle valve 21 and form first group pump units for operating the first actuator 26. Furthermore, the six pump units around the second cam element 4*b*', which are shown on the right side of FIG. 10, are associated with the second variable throttle valve 22 and form second group pump units for operating the second actuator 31. Of course, depending upon the number of actuators to be operated by the pump system according to the present invention, the drive shaft 4** may be provided with more than two eccentric cam elements corresponding to more than two group pump units which are associated with more than two variable throttle valves, in a similar manner.

In the various embodiments explained above, for individually adjusting the delivery volume and discharge pressure of the first and second group pump units, the variable throttle valves each disposed in the suction passage between the reservoir and the first or second group pump units may include a valve spool which is applied with the discharge pressure of the pump unit of relevant group as a pilot pressure, and an electromagnetic actuator may be provided for applying a controlled thrust to the valve spool in opposition to the pilot pressure. The valve spool is then maintained at an equilibrium position in which the thrust resulting from the discharge pressure of the pump unit is balanced with the thrust applied by the electromagnetic actuator so that the opening degree of the throttle valve is uniquely determined to optimize the delivery volume and discharge pressure of the working oil to be supplied to the actuators.

Figure 11:
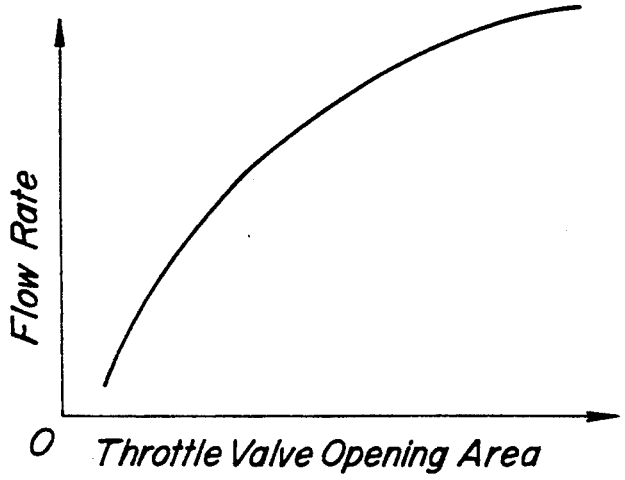
FIG. 11 is a diagram graphically showing the discharge flow rate characteristic of the pump system in relation to the throttle opening area.
Figure 12:
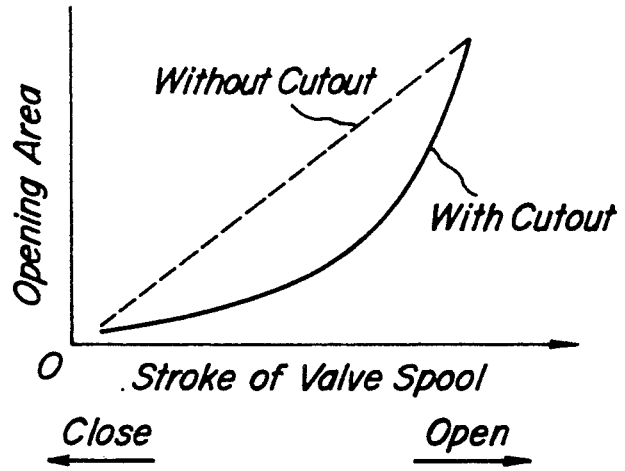
FIG. 12 is a diagram graphically showing the throttle opening area in relation to the stroke of the valve spool in a conventional throttle valve device.

Conventionally, the flow rate characteristic of the throttle valve in relation to the valve opening area is characterized in that, as substantially shown in FIG. 11, the flow rate variation in response to the opening area variation tends to become excessive particularly in the region of smaller opening area. In other words, the flow rate variation in response to a small displacement amount of the valve spool tends to become excessive so that the flow rate control by means of the throttle valve may become unstable. To compensate for such a stability problem, the end surface of the throttle valve spool may be partly cutout such that the valve opening area changes in a quadratic form as shown by solid line in FIG. 12.

When, however, the end surface of the throttle valve spool is partly cutout, the stroke of the throttle valve spool for achieving a predetermined valve opening area tends to increase as compared with a valve spool without such a cutout. Since the maximum stroke of the electromagnetic actuator is usually on the order of approximately 2 mm, it is often difficult for the actuator to accommodate the increased stroke of the valve spool, and it becomes necessary to increase the diameter of the valve spool. On the other hand, the increase in diameter of the throttle valve spool is not always an appropriate solution since it becomes difficult to achieve an accurate control of the flow rate due to an increased friction. Furthermore, besides a larger spring is required for applying the valve spool with a spring force in opposition to the pilot pressure, the increased inertia mass of the valve spool significantly degrades the response characteristic of the throttle valve.

The present invention provides a unique arrangement which is free from the above-mentioned stability problem by providing the throttle valve with a plurality of valve elements having mutually different flow rate characteristics in relation to the pilot pressure. To this end, the valve elements may be composed of spring-loaded spools, respectively, which are different from each other in spool diameter and/or spring bias force. The overall flow rate characteristic of the throttle valve can be deemed as the sum of the characteristics of the valve spools. Thus, it is readily possible to achieve a desired flow rate characteristic of the throttle valve as a whole which is quite similar to that of FIG. 12, as particularly shown by the solid line in FIG. 13, and which serves to achieve effectively stabilized control characteristics of the throttle valve.

One practical embodiment of the variable throttle device based on such concept is applied to a positive-displacement type pump system in the form of a fixed-cylinder type radial piston pump which will be explained below with reference to FIG. 14. The pump system 101 incorporating the variable throttle device 102 includes a pump housing 103, and a drive shaft 104 extending through the housing 103. The drive shaft 104 is journalled by bearings 105, 106, and provided with an eccentric cam element 104*a* at a location between the bearings 105, 106. The pump housing 103 is formed with a suction chamber 107 which accommodates the cam element 104*a* of the drive shaft 104. An annular ring element 108 is rotatably fitted onto the outer surface of the cam element 104*a*, and a plurality of hollow radial pistons 109, for example six in number, are arranged about the drive shaft 104 at an equiangular distance from each other, and resiliently urged against the ring element 108 on the cam element 104*a*.

The pistons 109 are slidably accommodated within respective cylinders 110 formed in the pump housing 103, and are reciprocally movable radially with reference to the longitudinal axis of the drive shaft 104, thereby forming a plurality of pump units. Each cylinder 110 has a radially outer end closed by a cap element 111 which is threadedly secured to the pump housing 103, so that a discharge chamber 112 of the pump unit is formed between the piston 109 and the cap element 112. Each piston 109 is open at the radially outer end and closed at the radially inner end, so that the interior space within the piston 109 is in communication with the discharge chamber 112. Furthermore, each piston 109 is urged against the ring element 108 on the cam element 104*a* of the drive shaft 104 by means of a compression coil spring 113, and has a peripheral wall formed with a side port 114 at a location which can be brought into the suction chamber 107 during the stroke motion of the piston 109.

The drive shaft 104 has one end (left end in FIG. 14) which is adapted to be driven by an appropriate prime mover, such as an internal combustion engine of an automotive vehicle, not shown, and is associated with an oil seal element 115 adjacent thereto. Another end (right end in FIG. 14) of the drive shaft 104 extends into a passage member 116 secured to the pump housing 103, and is associated with another oil seal element 117 adjacent thereto. The passage member 116 is formed with respectively predetermined numbers of suction and discharge passages 118, 119 to be connected to the pump units. The number of the suction passages 118 corresponds to the number of the pump unit groups, while the number of the discharge passages 119 corresponds to the total number of the pump units. The suction passage 118 is in communication with the suction chamber 107 through a port 120 formed in the pump housing 103, and the discharge passage 119 is in communication with the discharge chamber 112 through a port 121 also formed in the pump housing 103. A delivery valve 122 is disposed between the port 121 and the discharge passage 119 which opens when the working oil which has been pressurized above a predetermined pressure level is supplied thereto to permit a normal flow of the working oil from the port 121 into the discharge passage 119, and which inhibits a reverse flow of the working oil from the discharge passage 119 back into the port 121. An end cover member 123 is arranged on that side of the passage member 116 which is remote from the pump housing 103. The cover member 123 is formed with grooves 124 each communicating with the discharge passages 119 of a pump unit group. Each groove 124 is connected to a corresponding discharge port 125 of the pump system, which is to an accumulator 126 for accumulating the pressure of the working oil and an actuator 127 to be operated by the working oil, both included in a hydraulic actuating circuit 128.

The variable throttle device 102 to be provided for the above-mentioned pump system according to the present invention will be explained below. Each variable throttle device 102 is to control the flow rate of the working oil sucked from a reservoir 129 through suction passages 130*a*, 130*b* and flowing into the suction passage 118 in the passage member 116 corresponding to a predetermined pump unit group. As particularly shown in FIG. 15, the variable throttle device 102 in the illustrated embodiment includes two spool valves 131*a*, 131*b* composed of a common valve housing member 150, and two spool elements 133 which are axially slidably arranged within the housing member 150. The spool elements 133 are biased by compression coil springs 137*a*, 137*b*, respectively, which are different from each other only in terms of spring constant. Alternatively, or additionally, the spool elements 133 may be different from each other in their diameter. The valve housing member 150 is associated with feed-back port members 132 corresponding to the spool elements 133, respectively, to be supplied with a pilot pressure through pilot pressure passages 140*a*, 140*b*. The pilot pressure to be supplied to the feed back port members 132 through the pilot pressure passages 140*a*, 140*b* is the discharge pressure of the working oil discharged from a corresponding pump unit group. Each feed-back port member 132 is formed of an axial bore for axially slidably accommodating a feed-back plunger 139 whose inner end (left end in FIGS. 14 and 15) is brought into abutment with a corresponding spool element 133.

Figure 16A:
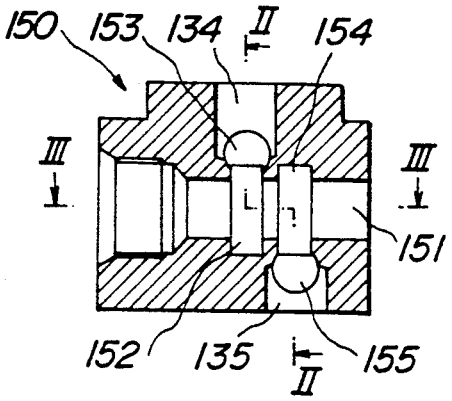
FIG. 16A is a longitudinal-sectional view showing the throttle region of the valve device of FIG. 15.
Figure 16B:
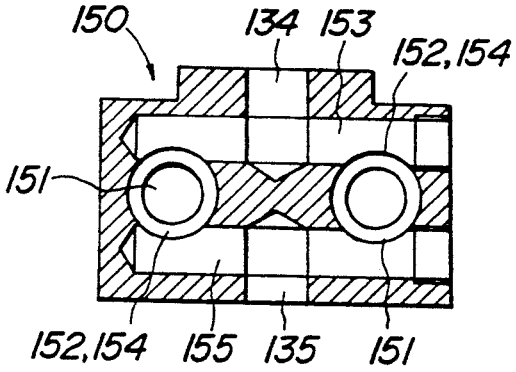
FIGS. 16B and 16C are respectively sectional views taken along the lines II—II and III—III in FIG. 16A.
Figure 16C:
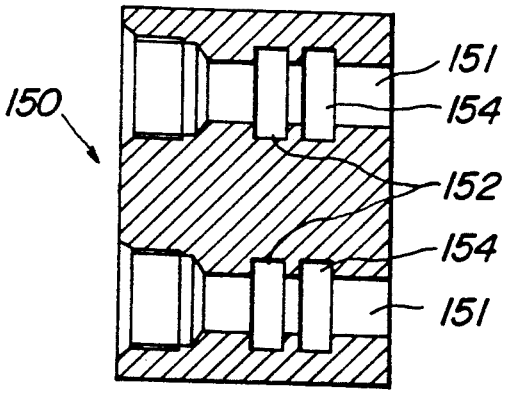

As particularly shown in FIGS. 16A, 16B, 16C, for each variable throttle device 102, the valve housing member 150 includes an inlet chamber 134 to be connected to the suction passage 130*a*, 130*b*, axial sleeves 151 for slidably accommodating the spool elements 133, a passage 153 for connecting the inlet chamber 134 to circumferential grooves 152 formed in the sleeves 151, an outlet chamber 135 to be connected with the suction passage 118, and a passage 155 for connecting the outlet chamber 135 to circumferential grooves 154 formed in the sleeves 151. The spool element 133 accommodated within the valve housing member 150 each provides a variable throttle 136 (FIG. 14) between the inlet and outlet chambers 134, 135, whose opening area varies during the stroke motion of the spool element.

An axial end of each spool element 133 remote from the feed-back plunger 139 is formed with a recess 133*a* which is engaged by the relevant coil spring 137*a*, 137*b*. The coil springs 137*a*, 137*b* are for biasing the relevant spool element 133 in a direction in which the opening area of the throttle 136 increases whereas the feed-back pilot pressure, i.e. the discharge pressure of the relevant pump unit group is applied to the opposite end of the spool element 133 for biasing it in a direction in which the opening area of the throttle 136 decreases.

On the side of the coil spring 137*a*, 137*b*, electromagnetic solenoids 143 are arranged opposite to the spool elements 133. These solenoids 143 are for optimizing the discharge pressure of the relevant pump unit group. Each solenoid 143 is composed of a casing 144 fixedly secured to the valve housing 150, an electromagnetic coil 145 accommodated within the casing 144, and a push rod 146 extending through the coil 145 and the coil spring 137*a* or 137*b*, which is brought into abutment with the the relevant spool element 133. The intensity of the electric current to be supplied to the electromagnetic coil 145 of the solenoid is controlled by a controller 148 based on appropriate input data 147.

The pump system according to the embodiment explained above with reference to FIGS. 14 and 15 and FIGS. 16A–16C achieves a pumping function essentially in a conventional manner, for which a detailed description will not be necessary. During the operation of the pump system, the flow rate of the working oil to be supplied to each pump unit group is controlled in the following manner. That is, the discharge pressure of the working oil discharged from the pump units of relevant pump unit group and supplied to the hydraulic actuating circuit 128 is applied to the feed-back plungers 139 of the spool valves 131*a*, 131*b* through the pilot pressure passages 140*a*, 140*b* to urge the spool elements 133 in a direction in which the opening area of the throttle 136 decreases. Each spool element 133 is further applied with a spring force of the coil spring 137*a* or 137*b* and an axial thrust by the push rod 146 of the solenoid 143, in a direction in which the opening area of the throttle 136 increases. The spool element 133 is thus maintained at an equilibrium position in which these forces are balanced with each other.

During the operation of the actuator 127 when a large amount of working oil has to be supplied to the actuator, the discharge pressure within the hydraulic actuating circuit 128 decreases. Due to a corresponding decrease in the pilot pressure applied to the feed-back plunger 139, the spool element 133 is moved in a direction in which the opening area of the throttle 136 increases. By this, an increased amount of working oil is sucked from the reservoir 129 into the suction chamber 107 of the relevant pump unit group to increase the flow rate of the working oil to be discharged and satisfy the demand of the actuator 127. Conversely, when the actuator 127 is out of operation or requires only a small amount of working oil, the discharge pressure within the hydraulic actuating circuit 128 increases. Due to a corresponding increase in the pilot pressure applied to the feed-back plunger 139, the spool element 133 is moved in a direction in which the opening area of the throttle 136 decreases. By this, a decreased amount of working oil is sucked from the reservoir 129 into the suction chamber 107 of the relevant pump unit group to increase the flow rate of the working oil.

Figure 13:
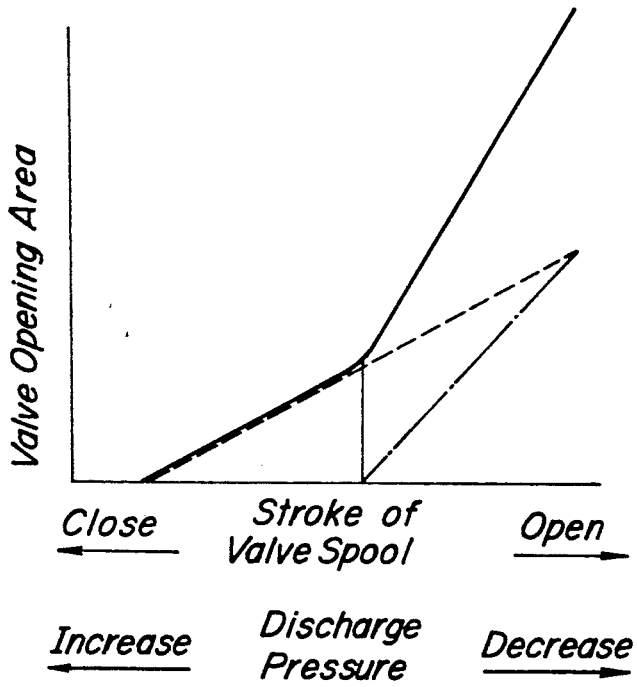
FIG. 13 is a diagram graphically showing the throttle opening area in relation to the stroke of the valve spool in the throttle valve device according to a further proposal of the present invention.

In this connection, due to the provision of two spool elements 133 which are different from each other in spool diameter and/or spring bias force, the overall flow rate characteristic of the throttle valve (i.e., the sum of the characteristics of the valve spools) is substantially as shown by the solid line in FIG. 13, making it possible to achieve effectively stabilized control characteristics of the throttle valve throughout the entire stroke range of the valve spool.

Figure 14:
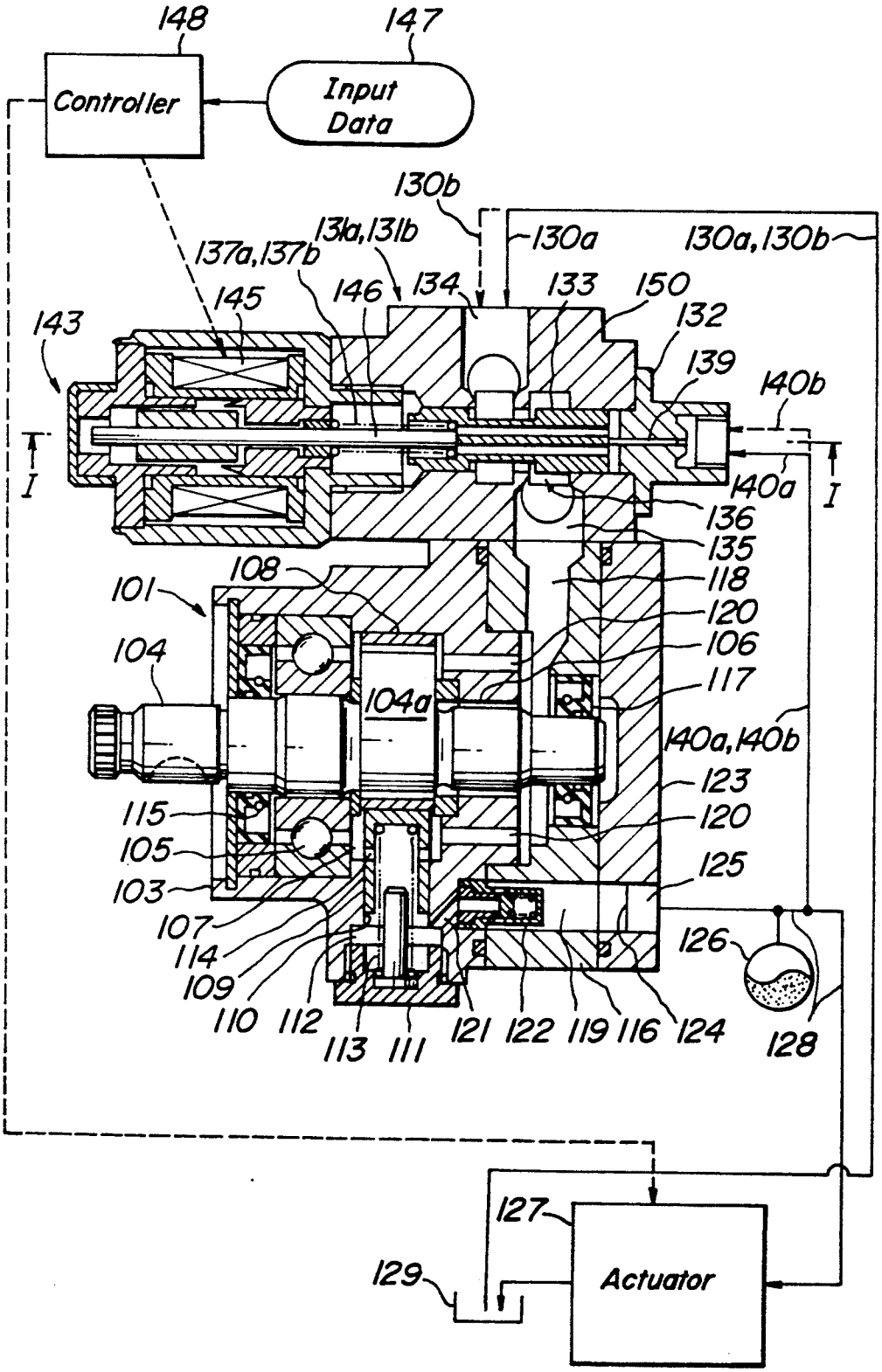
FIG. 14 is a longitudinal-sectional view showing a fixed-cylinder type radial piston pump system according to another embodiment of the present invention.
Figure 15:
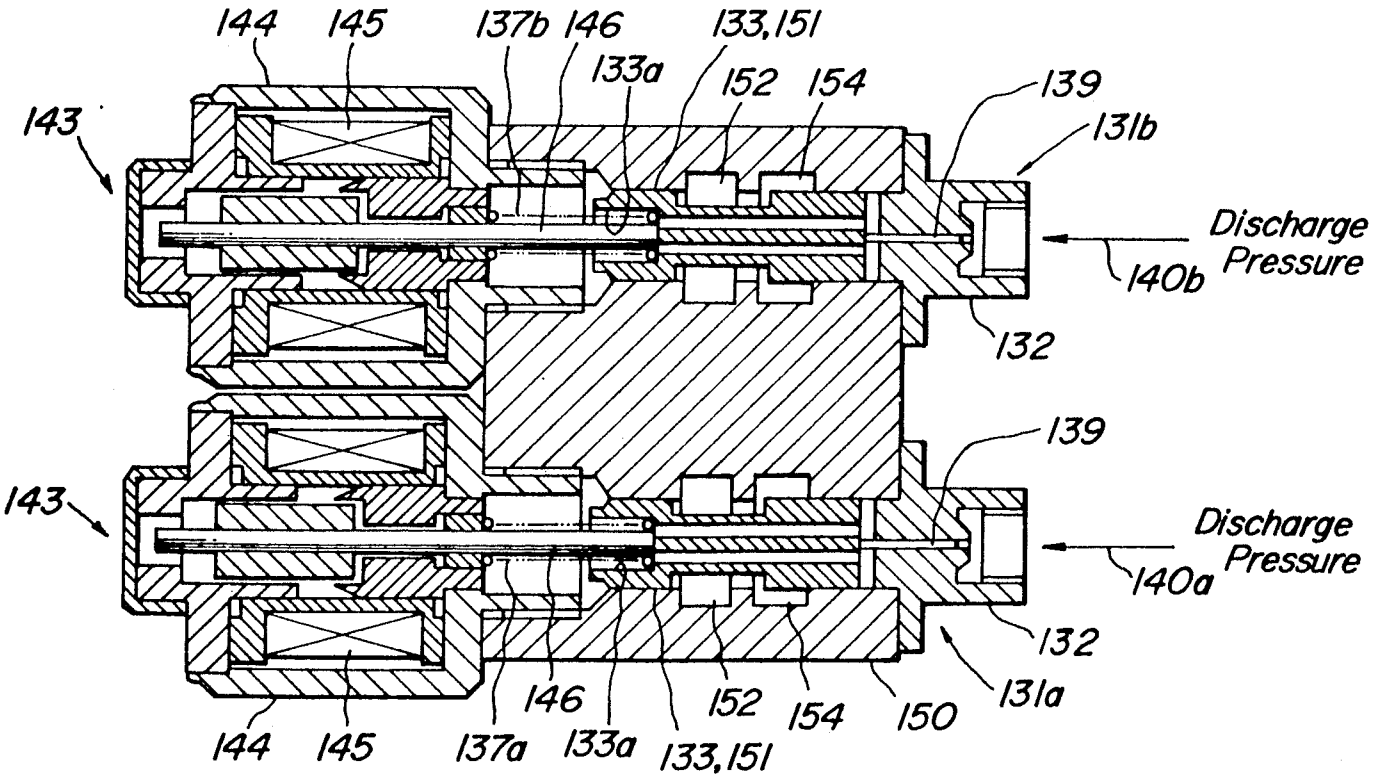
FIG. 15 is a sectional view taken along the line I—I in FIG. 14, showing one example of the throttle valve device.

Apart from the flow rate control as discussed above, the discharge pressure of each pump unit group in the pump system shown in FIG. 14 is carried out by the controller 148 in the following manner. That is, when a higher discharge pressure is required, an electric current of increased intensity is supplied to the electromagnetic coil 145 of the solenoid 143 to apply a higher thrust to the spool element 133 such that the spool element 133 assumes an equilibrium position in which the sum of the thrust by the solenoid 143 and the coil spring 137*a*, 137*b* is balanced with a higher discharge pressure of the pump units of the relevant group. Conversely, when a lower discharge pressure is required, an electric current of decreased intensity is supplied to the electromagnetic coil 145 of the solenoid 143 to apply a lower thrust to the spool element 133 such that the spool element 133 assumes an equilibrium position in which the sum of the thrust by the solenoid 143 and the coil spring 137*a*, 137*b* is balanced with a lower discharge pressure of the pump units of the relevant group.

It will be appreciated from the foregoing detailed description that the present invention provides an improved positive-displacement type pump system which makes it readily possible to individually adjust the delivery volume of the different groups of the pump units of the system.

While the present invention has been explained with reference to some specific embodiments, they were given by way of examples only and it is apparent that various alterations and/or modifications may be made without departing from the scope of the invention.

What is claimed is:

1. A positive-displacement type pump system comprising:

a common pump housing formed with a plurality of cylinders;

a plurality of pistons slidably received in the respective cylinders and cooperating therewith to form a plurality of pump units;

a drive shaft extending into the housing for driving the pistons into reciprocating motion within the respective cylinders; and control means for adjusting delivery volume of the pump units, including at least (i) first throttle valve means disposed in a first suction passage between a working fluid source and a first group of the pump units for operating a first actuator, for adjusting a flow rate of a working fluid from said working fluid source to be supplied to the pump units of the first group, and (ii) second throttle valve means disposed in a second suction passage between said working fluid source and a second group of said pump units for operating a second actuator, for adjusting a flow rate of a working fluid from said working fluid source to be supplied to the pump units of the second group independently of said first throttle means for the first group, and thereby permitting individual adjustment of the pump units of the first and second groups in terms of their respective delivery volumes.

2. A pump system as set forth in claim 1, further comprising a check valve disposed between a suction port of each pump unit and the relevant throttle means.

3. A pump system as set forth in claim 1, wherein the piston of each pump unit is of hollow configuration and formed with an outer circumferential groove, said groove having a through hole for maintaining the groove in communication with an interior space of the piston.

4. A pump system as set forth in claim 1, wherein at least one of said first and second throttle valve means comprises at least one valve element which is applied with a discharge pressure of the relevant pump unit as a pilot pressure.

5. A pump system as set forth in claim 4, further comprising an electromagnetic actuator means for applying a controlled thrust to said valve element in opposition to said pilot pressure, thereby to adjust a discharge pressure of the relevant pump unit.

6. A pump system as set forth in claim 4, wherein at least one of said first and second throttle valve means comprises a plurality of valve elements having mutually different throttle characteristics in relation to the pilot pressure.

7. A pump system as set forth in claim 6, wherein said valve elements are composed of spring-loaded spools, respectively, which are different from each other in spool diameter.

8. A pump system as set forth in claim 6, wherein said valve elements are composed of spring-loaded spools, respectively, which are different from each other in spring bias force.

9. A pump system as set forth in claim 1, which is composed as a fixed-cylinder type radial piston pump system.

10. A positive-displacement type pump system, comprising:

a common pump housing formed with a plurality of cylinders;

a plurality of pistons slidably received in the respective cylinders and cooperating therewith to form a plurality of pump units;

a drive shaft extending into the housing for driving the pistons into reciprocating motion within the respective cylinders; and control means for adjusting delivery volumes of the pump units, including throttle valve means disposed in suction passage means between a working fluid source and said pump units, said throttle valve means being composed of a plurality of valve elements which are applied with a discharge pressure of relevant pump unit as a pilot pressure, said valve elements having mutually different throttle characteristics in relation to the pilot pressure.

11. A pump system as set forth in claim 10, wherein said valve elements are composed of spring-loaded spool, respectively which are different from each other in spool diameter.

12. A pump system as set forth in claim 10, wherein said valve elements are composed of spring-loaded spools, respectively, which are different from each other in spring bias force.

13. A pump system as set forth in claim 10, further comprising an electromagnetic actuator means for applying a controlled thrust to said valve elements in opposition to said pilot pressure, thereby to adjust a discharge pressure of the relevant pump unit.

14. A pump system as set forth in claim 10, which is composed as a fixed-cylinder type radial piston pump system.

* * * * *